US007665681B2

(12) United States Patent
Chen

(10) Patent No.: US 7,665,681 B2
(45) Date of Patent: Feb. 23, 2010

(54) FINE GRINDING ROLLER MILL

(75) Inventor: Michael M. Chen, Naperville, IL (US)

(73) Assignee: ALSTOM Technology Ltd, Baden (CH)

( * ) Notice: Subject to any disclaimer, the term of this patent is extended or adjusted under 35 U.S.C. 154(b) by 148 days.

(21) Appl. No.: 11/939,621

(22) Filed: Nov. 14, 2007

(65) Prior Publication Data

US 2009/0121056 A1 May 14, 2009

(51) Int. Cl.
*B02C 23/32* (2006.01)

(52) U.S. Cl. ..... 241/52; 241/57; 241/79.1; 241/80; 241/119; 241/129

(58) Field of Classification Search ..... 241/119, 241/79.1, 129, 57, 52, 80
See application file for complete search history.

(56) References Cited

U.S. PATENT DOCUMENTS

| | | | |
|---|---|---|---|
| 4,640,464 | A | 2/1987 | Musto et al. |
| 5,279,466 | A | 1/1994 | Williams |
| 5,330,110 | A | 7/1994 | Williams |
| 6,902,126 | B2 | 6/2005 | Chen et al. |
| 7,028,837 | B2 | 4/2006 | Chen et al. |

FOREIGN PATENT DOCUMENTS

| | | | |
|---|---|---|---|
| JP | 58-92467 | | 6/1983 |
| JP | 6-55088 | * | 3/1994 |

OTHER PUBLICATIONS

PCT International Search Report and The Written Opinion of the International Searching Authority dated Oct. 3, 2009—(PCT/US2008/083849).

* cited by examiner

*Primary Examiner*—Mark Rosenbaum
(74) *Attorney, Agent, or Firm*—Lawrence P. Zale

(57) ABSTRACT

A roller mill for pulverizing material and separating the pulverized material has a mill for crushing the material and a classifier disposed on the mill for separating the crushed material. The mill includes a grinding mechanism that has a plurality of grinding rolls and a grinding ring that coact to pulverize material within a mill housing, which defines a grinding chamber. The classifier is a centrifugal-type classifier having a motor-driven rotor disposed within a classifier housing, which define a classifying chamber. The rotor has a plurality of blades that extend outwardly from the rotor. As the rotor rotates within the classifying chamber, the blades separate fine sized particles from oversized particles by passing the finer sized particles through the blades, and contacting and propelling the oversized particles against the classifier housing. The oversize particles fall downward through an outer annular passage defined by a baffle and the mill housing back to the grinding mechanism. The baffle is disposed along the inner periphery of the mill housing spaced at a distance from the mill housing to provide an inner passage and an outer annular passage. The inner passage directs particle-laden air upward through the grinding chamber to the classifier. The goat annular passage receives and directs the oversized particles downward to the grinding mechanism of the mill through an opening at the bottom of the outer annular passage for directing the oversized particles to the grinding mechanism.

20 Claims, 5 Drawing Sheets

FINE GRINDING ROLLER MILL

TECHNICAL FIELD

The present disclosure relates generally to a roller mill, and more particularly, to a roller mill having a return passage for oversized particles separated from fine particles to improve the grinding efficiency of the roller mill.

BACKGROUND

It has long been known in the prior art to provide apparatus for purposes of effecting the grinding and pulverizing of certain materials. More specifically, the prior art is replete with examples of various types of apparatus that have been used to effect such grinding of a multiplicity of materials. Coal is one such material wherein there is a need that it be ground to a particular fineness in order to render it suitable for the use in, for example, a coal-fired steam generating power plan.

One particular coal pulverizing apparatus, which is to be found in the prior art, is a roller mill. An exemplary roller mill with an integral classifier is shown and described in U.S. Pat. Nos. 4,640,464 and 7,028,847. An exemplary roller mill 10 having an integral classifier 12 is depicted in FIG. 1. As is typical of such a roller mill, the mill includes a plurality of grinding rollers 14 that toll along a grinding ring 16 for pulverizing the material to a desired particle size, which defines a grinding zone 18. A blower (not shown) generates an upward airflow 20 that draws fine particles upward through a grinding chamber 22 to the classifier 12 disposed above the mill housing 24 and in fluid communication therewith. The classifier has a centrifugal-type separator 25 that separates the oversize particles from the finer particles. The finer particles pass through the classifier through an output duct or port 26, as shown by airflow 28, while the oversized particles fall back down to the grinding chamber 22 and rollers 14 for continued grinding, as shown by downward particle flow 30.

It has been found that when the roller mill 10 is used for grinding fine particle sizes, a significant portion of the oversized particles rejected by the classifier at the top of the mill can still be quite fine. These rejected oversized particles returning back to the grinding zone 18 along the mill housing 24 in the downward particle flow 30 are subject to the airflow 20 flowing upward from the grinding chamber 22 to the classifier 12. This upward airflow 20 can entrain the rejected oversized particles quite easily and recirculate them back to the classifier, as shown at 34, where the classifier will reject the recirculated oversized particles again. This situation creates an internal recirculation of the oversized particles between the grinding chamber 22 and the classifier 12. As a result, a significant amount of rejected particles may never make it back to the grinding area to get further reground. These rejected oversized particles are thus suspended in the air stream, causing a pressure drop, which reduces mill capacity, and thus lowers the mill's efficiency. Therefore, there is a need to reduce or eliminate this recirculation phenomenon of these rejected oversized particles from recirculating between the grinding chamber and the classifier chamber without being reground.

One prior art separator apparatus disclosed in U.S. Pat. No. 5,279,466 shows a roller grinding mill having a classifier that redirects the oversized particles to a return path that is different from the upward flow of material from the mill so that the output from the mill is substantially free of being interfered with its movement by returning the oversized particles through a conduit or pipe back to the material feed or grinding chamber. As shown in this prior art, the separator apparatus has a rotor with a plurality of blades that centrifugally directs oversized particles to the outer wall of the separator apparatus. The oversize particles fall within an internal passage defined by the wall of the roller mill and the outer wall of the classifier. The particles are then funneled to an opening and/or a conduit that may direct the oversized particles to the rotary feeder or back into the grinding chamber. While removing the oversized particles from the upward airflow, the funneling of the oversized particles to an opening or conduit is susceptible to potential clumping of the particles and/or clogging of the opening and conduit. Furthermore, the depositing of the collected oversized particles concentrated at specific locations along the grinding ring will result in a non-uniform bed depth due to the localized depositing of the return of oversized particles, resulting in a decrease in grinding efficiency and/or increase in mill grinding noise. Furthermore, the device provides an external return path for the oversize particles that requires a relatively complex and costly oversized classifier housing, chutes, and conduits for accommodating the return path for the oversized particles.

What is needed, therefore, is a means for providing a simple return path separate from the central flow of fine particles from the grinding chamber to the classifier back to grinding zone, whereby the oversized particles rejected by the classifier are distributed in the grinding chamber in a less concentrated manner around the grinding ring to provide a more efficient grinding process.

SUMMARY

According to the aspects illustrated herein, there is provided a roller mill for pulverizing material having a mill, a classifier, and a baffle. The mill has a grinding mechanism of at least one grinding roll and grinding ring that co-acts to pulverize material within the mill housing that defines a grinding chamber. The classifier includes a rotor having a plurality of blades disposed within a classifier housing defining a classifying chamber. The rotor rotates to separate fine sized particles from oversized particles, whereby the finer sized particles pass through the blades and exit the classifier and the oversized particles are propelled outward against the classifier housing. The grinding chamber is in fluid communication with the classifying chamber. The baffle disposed along the inner periphery of the mill housing is spaced at a distance from the mill housing to provide an inner passage and an outer annular passage. The inner passage directs particle-laden air upward through the grinding chamber to the classifier. The outer annular passage receives and directs the oversized particles downward to the grinding mechanism of the mill such that the baffle minimizes influence of the upward particle-laden airflow through the inner passage of the grinding chamber with the downward flow of the oversized particles. The baffle has an opening at the bottom of the outer annular passage for directing the oversized particles to the grinding mechanism.

According to the other aspects illustrated herein, there is a mill for pulverizing material having a grinding means, a classifying means, and a baffle. The grinding means pulverizes material within a mill housing that defines a grinding chamber. The classifying means centrifugally separates oversized particles from finer particles, wherein the finer sized particles pass through the classifying means and the oversized particles are propelled outward and downward to the grinding means. The baffle is disposed along the inner periphery of the mill housing spaced at a distance from the mill housing to provide an inner passage and an outer annular passage. The inner passage directs particle-laden air upward through the grinding chamber to the classifier. The outer annular passage receives and directs the oversized particles downward to the grinding mechanism of the mill. The baffle minimizes the influence of the upward particle-laden airflow through the inner passage of the grinding chamber. The baffle has an opening at the bottom of the outer annular passage for directing the oversized particles to the grinding mechanism.

The above described and other features are exemplified by the following figures and detailed description.

BRIEF DESCRIPTION OF THE DRAWINGS

Referring now to the Figures, which are exemplary embodiments, and wherein the like elements are numbered alike.

DETAILED DESCRIPTION

Figure 2:
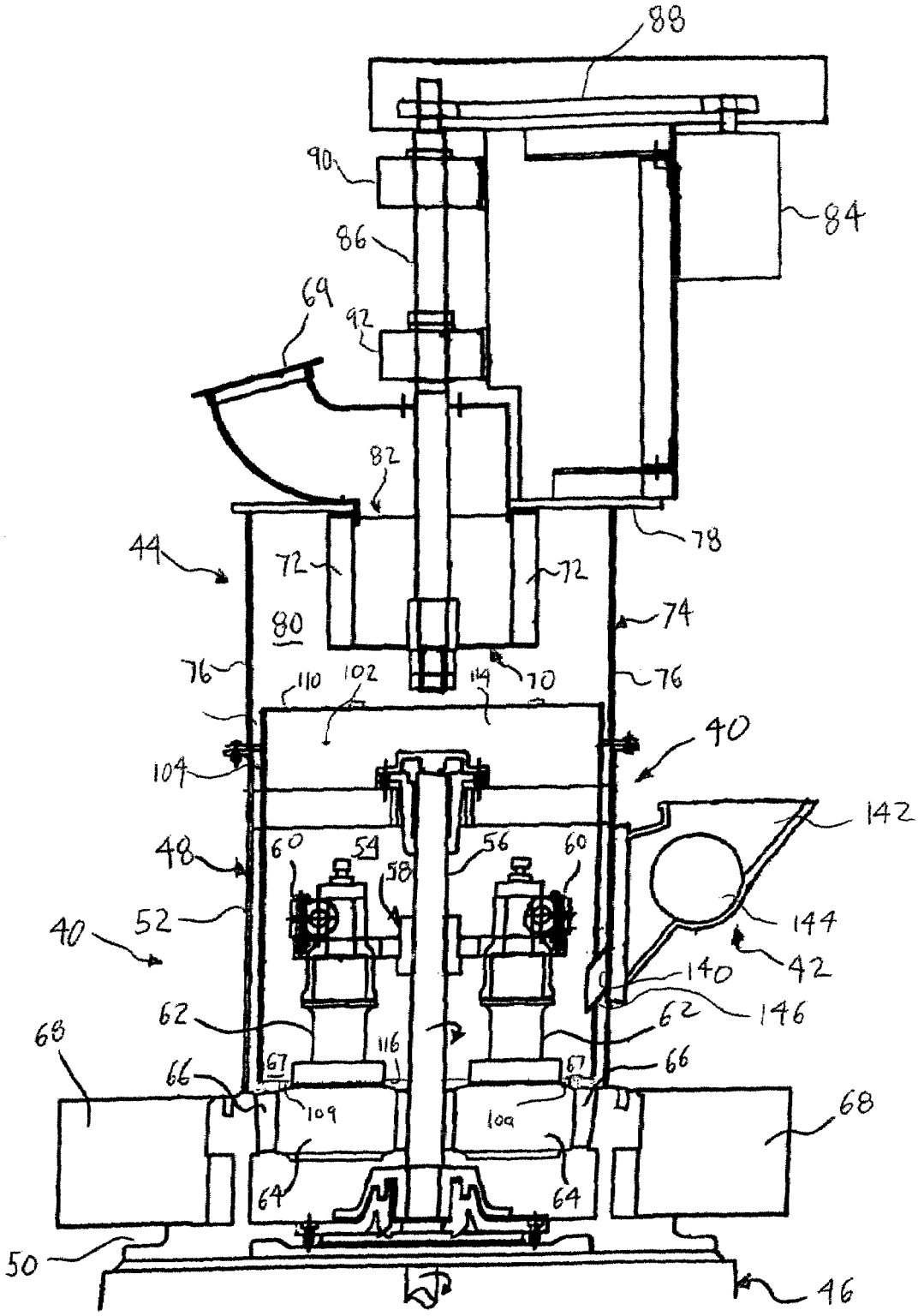
FIG. 2 is a cross-sectional view of a roller mill including a centrifugal-type classifier and a rotary feed apparatus in accordance with the present invention.

Referring to FIG. 2, a roller mill, generally designated by reference numeral 40, is depicted therein with a rotary feeder 42 and classifier 44, illustrated cooperatively associated therewith. Inasmuch as the nature of the construction and the mode of operation of roller mills per se are well-known to those skilled in the art, it is not deemed necessary, therefore, to set forth herein a detailed description of the roller mill 40 illustrated in FIG. 2. Provided herein is merely a description of the nature of the construction and the mode of operation of the components of the roller mill 40, the rotary feeder 42, and the classifier 44. For a more detailed description of the nature of the construction of the components of the roller mill 40 and classifier 44 one may refer to U.S. Pat. No. 4,640,464 and U.S. Pat. No. 6,902,126.

Referring to FIG. 2, the roller mill 40 as illustrated therein includes a mill base 46 to which a mill side 48 is suitably affixed in known fashion. The mill side 48 includes a mill side base 50 and an annular wall 52 attached in known fashion to the mill side base to form a grinding chamber 54 wherein the grinding takes place. Housed within the mill base 46 and extending upwardly into the mill side 48 is a mill shaft 56, which is part of a gear assembly (not shown). The gear assembly functions in a conventional fashion, such that a mill motor (not shown) drives the gear assembly in a known fashion to thereby rotate the mill shaft 56 in either a clockwise or counterclockwise direction.

Figure 3:
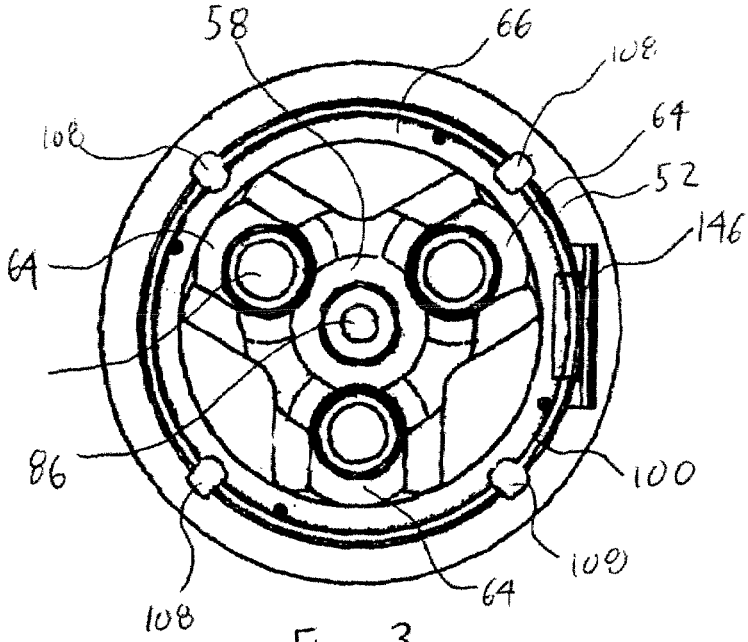
FIG. 3 is a cross-sectional view of the roller mill of FIG. 2 taken through the lines 2-2.

A spider 58 is suitably mounted at the upper end of a mill shaft 56 of the gear assembly so as to be rotatable therewith. Moreover, the spider 58 has a plurality of trunnion bearing assemblies 60 cooperatively associated therewith in a suitable fashion. In accordance with the illustration of the roller mill 40 of FIG. 2, two such trunnion bearing assemblies 60 are shown cooperatively associated with the spider 58. In FIGS. 2 and 3, a journal assembly 62 is associated with each of the trunnion bearing assemblies 60. Furthermore, on each of the journal assemblies 62 there is suitably mounted, in known fashion, a grinding roll 64. The grinding rolls 64 to which further reference will be had hereinafter comprise one of the grinding elements of the roller mill 40. While two grinding rolls 64 are shown in FIG. 2, one will appreciate that the roller mill may have 3, 4 or more grinding rolls as shown in FIG. 3.

The grinding rolls 64 coact with a grinding ring 66 to pulverize the material passing therebetween, which is defined as the grinding zone 67 in the grinding chamber 54. The grinding ring 66, which is essentially circular in configuration, is suitably mounted through the use of conventional mounting means (not shown) within the mill side base 50 of the roller mill 40 so as to be positioned in juxtaposed relation to the grinding rolls 64. The journal assemblies 60 are actuated to urge trunnions 60 and thus the rolls against the grinding ring. The roller mill 40 also includes an annular return air housing 68. The return air housing 68 is suitably located in juxtaposition relation to the mill side base 50 of the roller mill 40 so as to provide a flow path for airflow between the interior and the exterior of the roller mill, which will be described in greater detail hereinafter.

The classifier 44 is mounted in conventional fashion on the mill side 48 of the roller mill 40 so as to be coaxially aligned therewith. Further, in known fashion the classifier 44 is operative to separate particles according to particle size of the material that has been ground within the roller mill 40 through the coaction of the grinding rolls 64 with the grinding ring 66. The classifier 44 is suitably provided at the upper end thereof with an outlet or duct 69.

Figure 4:
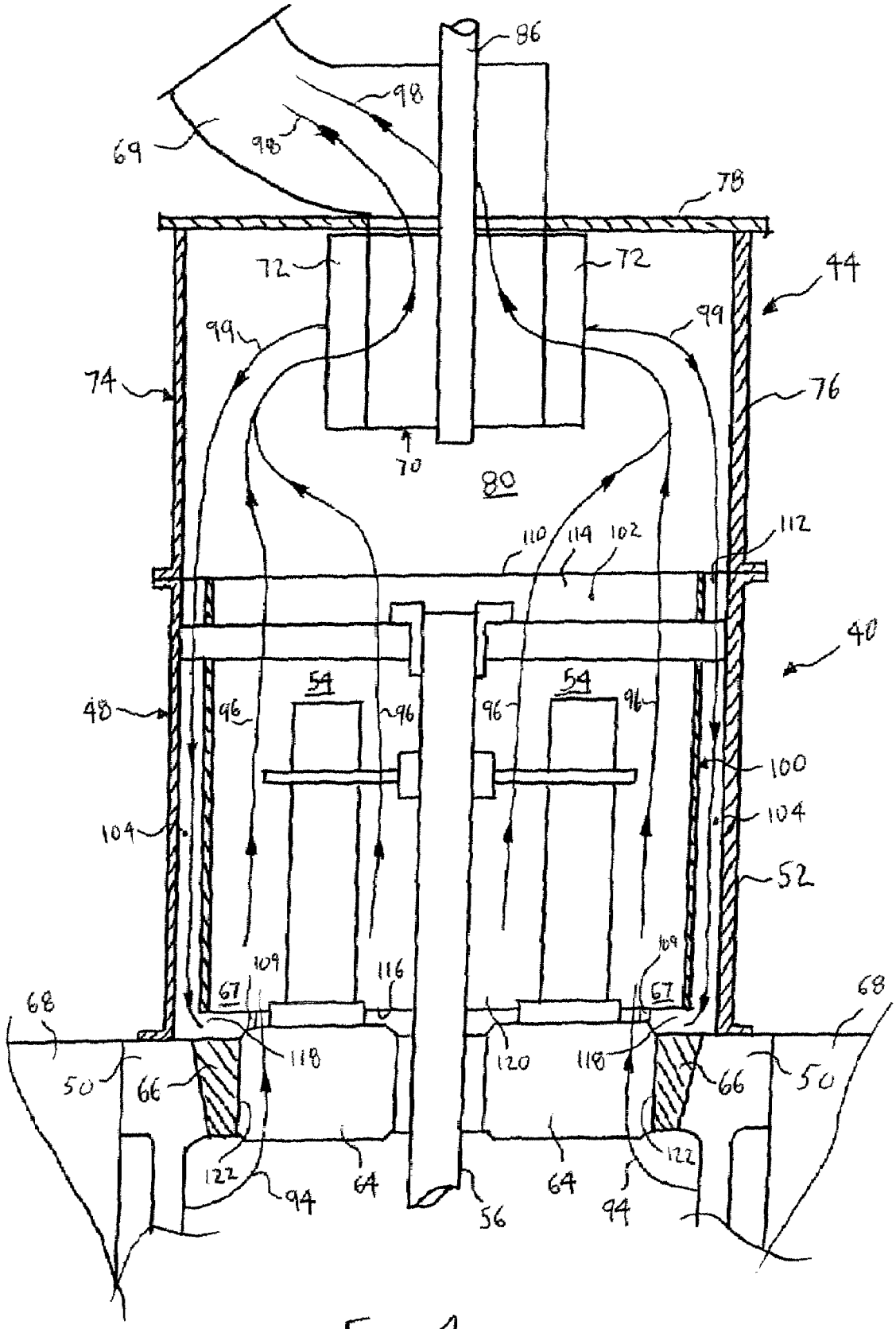
FIG. 4 is a cross-sectional schematic view of a roller mill embodying the present invention illustrating the airflow through the roller mill.

The classifier 44 depicted in FIGS. 2 and 4 is an example of a centrifugal-type classifier, which has a rotor 70 carrying a plurality of circumferentially-spaced blades 72 that extend outwardly. The rotor is disposed within an open-ended housing 74 having side walls 76 and a top wall 78 which defines a separator chamber 80. The duct 69 is in fluid communication with the separator chamber 80 through an opening 82 in the top wall 78. A motor 84 mounted at the top of the classifier housing 74 rotates the rotor 70 of the classifier 44 in either the clockwise or counterclockwise direction. The motor 84 is mechanically linked to a vertical drive shaft 86 by a drive belt, drive chain or other suitable means 88 known in the art. The drive shaft 86 is coaxial with the mill shaft 56 of the roller mill 40 and is supported by upper and lower bearings 90, 92. The classifier rotor 70 is mounted to the lower end portion of the classifier drive shaft 86.

Figure 8:
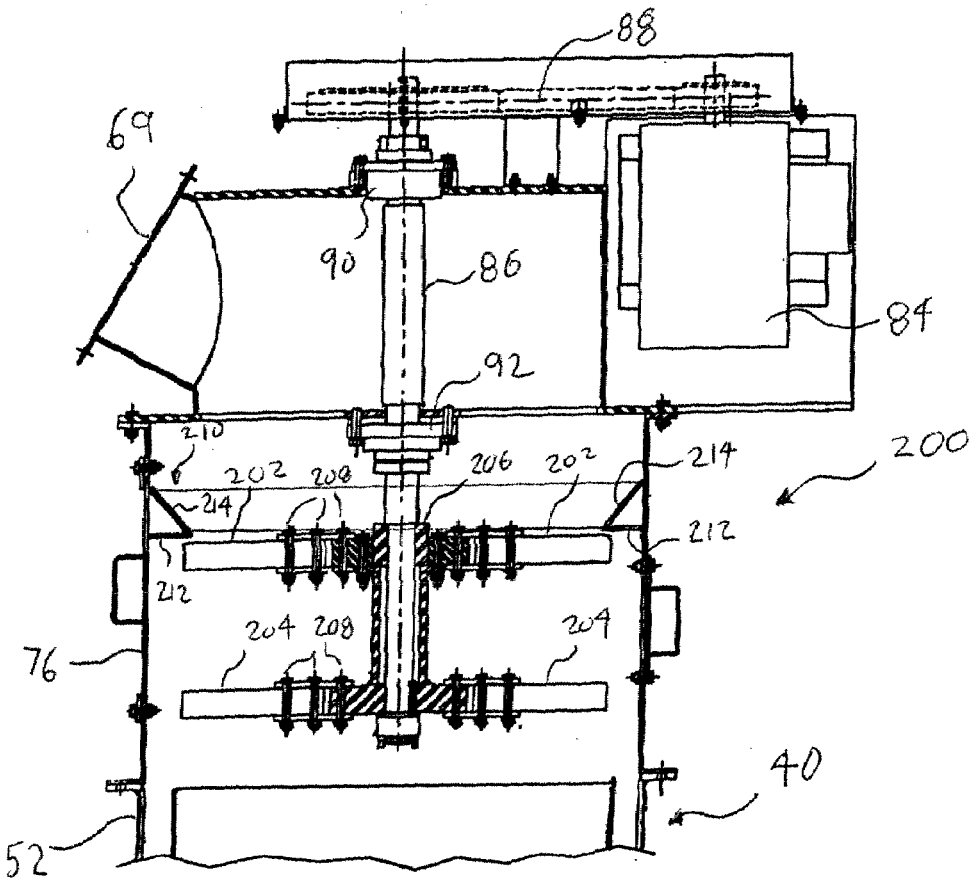
FIG. 8 is a cross-sectional view of a double whizzer classifier embodying the present invention.

In the operation of the classifier 44, as best shown in FIG. 4, a blower (not shown) draws air upwardly from the return air housing 68 through the grinding zone 67, the grinding chamber 54, and the separator chamber 80, and then out through the duct 69. As airflow 94 passes up through the grinding rolls 64 and grinding ring 66, fine ground particles are picked up in the airflow. The fine particles are carried in airflow 96 through the grinding chamber 54 into the separator chamber 80, where the particle-laden air is drawn through the rotating blades 72 of the rotor 70 of the classifier 44. As the particle-laden air passes through the rotating blades, the finer particles flow past the blades and out of the duct 69 as depicted by airflow 98, while the larger oversized particles are being propelled towards the classifier housing by centrifugal force, which then fall downwards back to the grinding chamber 54 by gravity, as depicted by particle flow 99. Classifiers that function in this manner of using a rotor 70 having a plurality of blades 72 for separating the fine particles from the oversized particles are known in the prior art as centrifugal type classifiers. Other centrifugal type classifiers are a turbine, a single stage whizzer and a double stage whizzer. A double stage whizzer 200 is illustrated in FIG. 8, which will be described in greater detail hereinafter.

Figure 1:
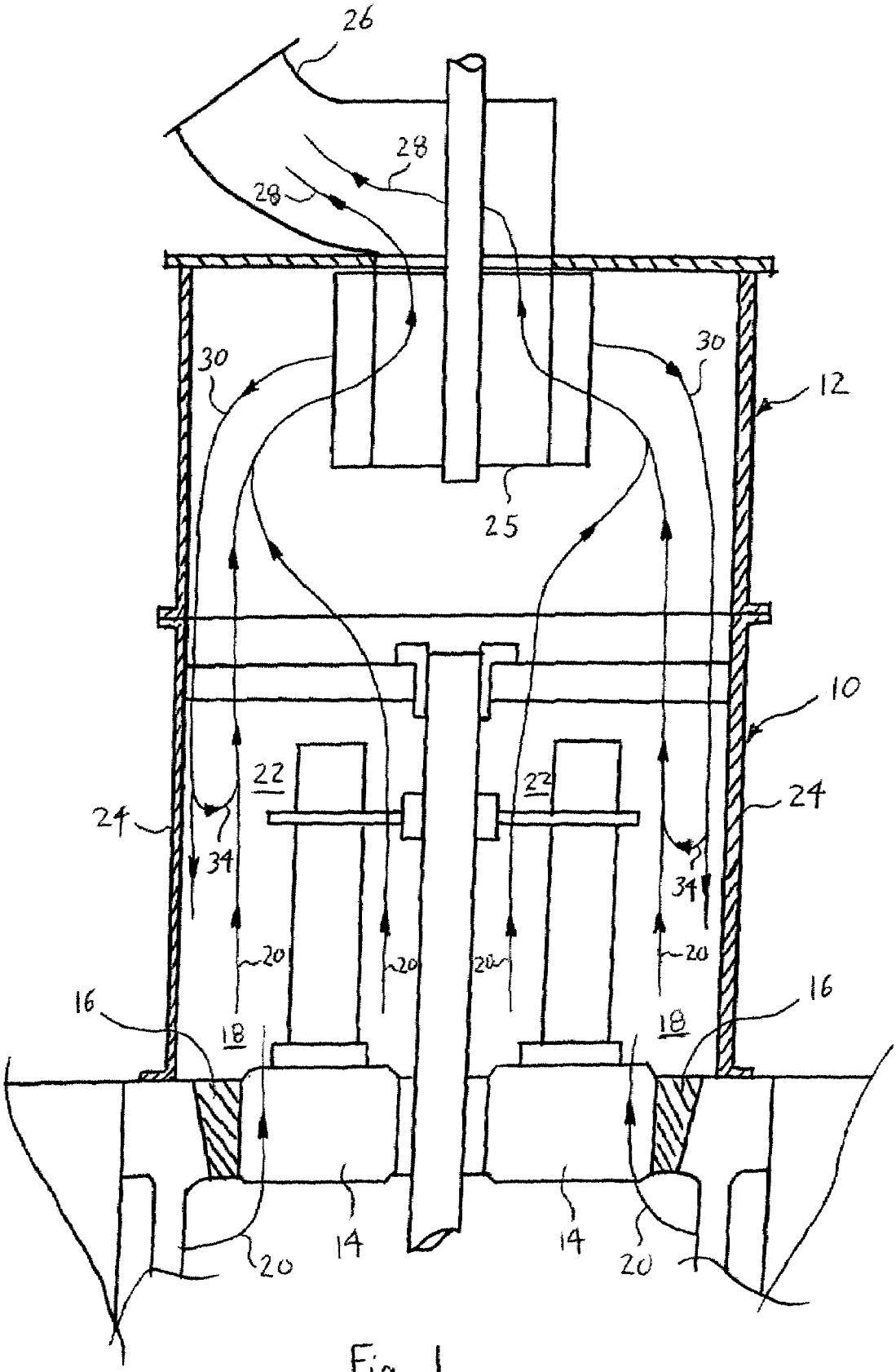
Fig. 1 (prior art)
FIG. 1 is a cross-sectional schematic view of a roller mill including an integral classifier illustrative of known prior art.

As discussed in the background in FIG. 1, the rejected oversized particles falling back down to the grinding rolls 14 and ring 16 may be recirculated back up at 34 to the classifier 12 without being further ground. To reduce or eliminate this recirculation, the present invention shown in FIGS. 2-4, includes a baffle 100 disposed within the mill side housing 48 of the roller mill 40.

As best shown in FIGS. 2-4, the baffle 100 is generally tube-shaped formed of a sheet metal material, which is secured in fixed relationship to the side wall 52 of the roller mill 40. The baffle 100 is disposed circumferentially around the grinding chamber 54 and spaced inward a distance from the mill side 48, to define two spaces within the roller mill 10, a central inner passage 102 and an outer annular return passage 104. As best shown in FIG. 4, the inner passage 102 provides means for directing airflow 96 upward from the grinding zone 67 to the separator chamber 80 of the classifier 44, while the baffle 100 and mill side wall 52 of the roller mill 40 define the outer annular return passage 104 for directing the downward particle flow 99 laden with oversized particles back to the grinding zone 67 of the roller mill 40.

The baffle 100 is secured in fixed spaced relation to the mill side 48 by a plurality of stand-offs 108 and/or legs 109 circumferentially spaced around the baffle. The baffle has an upper edge 110 that defines an input opening 112 of the return passage 104 and an output opening 114 of the inner passage 102. The baffle has a lower edge 116 that defines an output opening 118 of the return passage 104 and an input opening 120 of the inner passage 102.

As noted hereinbefore, referring to FIGS. 2-4, the baffle 86 extends circumferentially around the outer periphery of the grinding chamber 54. The baffle 100 is spaced a predetermined distance from the mill wall 52 to form the outer annular return passage 104 for the oversize particles rejected by the classifier 44. The width of the annular space 104 between the baffle 100 and the mill wall 52 is sufficient to receive the rejected oversized particles. In one embodiment the baffle 100 is disposed over a portion of the grinding ring 66. More, specifically, the diameter of the baffle 86 is approximately at the midpoint between the mill side wall 52 and the inner surface 122 of the grinding ring 66. Therefore, the diameter of the baffle is approximately:

$$D_{baffle}=0.5(D_h+D_r)$$

wherein $D_{baffle}$ is the diameter of the baffle; $D_h$ is the inner diameter of the mill housing; and $D_r$ is the inner diameter of the grinding ring.

Referring to FIGS. 2 and 4, the lower edge 116 of the baffle 100 is spaced a distance from the upper portion of the mill base 50 and the grinding ring 66, such that there is sufficient clearance for the oversized particles to easily flow from the return passage 104 through the output opening 118 to the grinding zone 67. The height of the output opening 118 of the annular return passage 104 at the lower edge 116 of the baffle 100 is thus the spacing between grinding ring 66 and the lower edge of the baffle. The output opening of the return passage 104 should be approximately:

$$S_{baffle}=0.5(D_b-D_r)\tan(\theta)+1 \text{ inch}$$

wherein $S_{baffle}$ is the spacing between the lower edge of the baffle and the grinding ring; $D_b$ is the diameter of the baffle; $D_r$ is the inner diameter of the grinding ring; and $\theta$ is the angle of repose of oversized material or annular ramp.

Figure 5A:
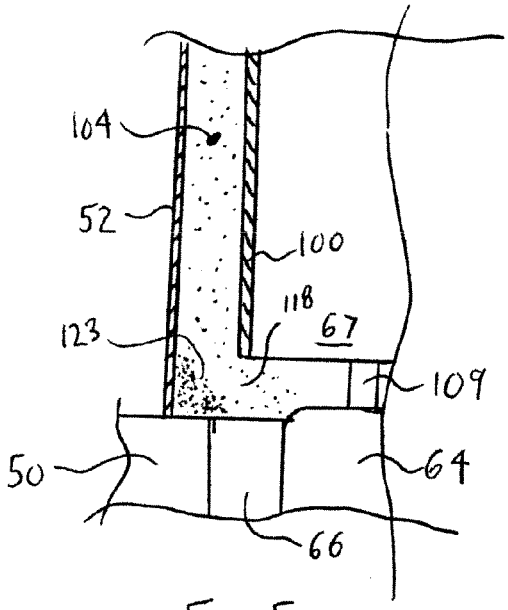
FIG. 5*a* is a cross-sectional view of a lower portion of the roller mill of FIG. 2 illustrating a lower portion of a baffle and mill side wall at the grind zone.

Typically, the material angle ($\theta$) of repose is approximately 40 degrees. One skilled in the art can appreciate that as the oversized particles flow downward through the annular passage 104 and out the lower output opening 118 into the grinding zone 67, particles will collect around the outer edge and corner along the bottom outer edge of roller mill 40. As such, the material will collect in the form of a ramp 123 having a slope of approximately 40 degrees as illustrated in FIG. 5*a*. This collected material is factored in, as shown above, when determining the height of the output opening 118. While the output opening 118 must be of sufficient size to ensure free particle flow from the annular passage 104 to the grinding zone 67, the height of the output opening 118 should be small enough to prevent the upward airflows 94,96 from flowing into the return passage 104. For example, the height of the output opening 118 may not be more than one inch over $0.5(D_b-D_r)\tan(\theta)$. While the formula above provides for an additional one (1) inch spacing for the spacing ($S_{baffle}$), the present invention contemplates that the additional may be less or greater than one (1) inch providing the lower outlet 118 is sufficiently space to permit passage of the oversize particles while eliminating or minimizing upward air flows 94,96 (see FIG. 4) therethrough.

Figure 5B:
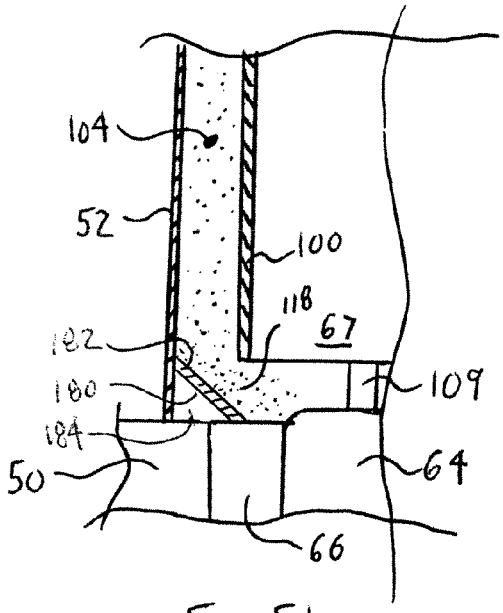
FIG. 5*b* is a cross-sectional view of a lower portion of the roller mill of FIG. 2 illustrating the lower portion of the baffle and mill side wall at the grind zone having a annular ramp in accordance with the present invention.

As shown in FIG. 5*b*, the present invention may include an annular ramp 180 disposed at an angle circumferentially around the outer lower edge or corner 184 of the roller mill 40 to prevent the build up of oversized particles at bottom of the annular passage 104 (as shown in FIG. 5*b*) and provide a sloped surface 182 for directing the oversized particles to the lower output opening 118 and into the grinding zone 67. The angle of the sloped surface 182 may be approximately in the range of 30-60 degrees. Generally, the angle of the sloped surface 182 should be sufficiently steep to promote the exit of the oversized particles from the annular passage 104, while allowing a sufficiently small lower output opening 118 to prevent or minimize upward air flows 94,96 (see FIG. 4) from the grinding chamber into the annular passage. While the annular ramp 180 is shown as formed a sheet of material, the present invention contemplates the annular ramp may be in the form of a wedge that fits into the lower outer corner 184 of the roller mill 40.

Regarding the height of the baffle 100, the baffle should extend as far upward as possible such that restriction of the upward airflow 96 through the output opening 114 of the inner passage 102 of the baffle 100 to the classifier 44 is minimized to provide efficient operation of the classifier. Typically, the baffle 100 can extend to a height about equal to height of the mill side housing 48, as shown in FIGS. 2 and 4. However, the invention contemplates that the elevation of the upper edge 110 of the baffle 100 may be disposed above or below the height of the mill side housing 48. For example, an optimal elevation of the baffle 100 for a roller mill 40 having a turbine-type classifier similar to that shown is:

$$S_{baffle}=(D_b-D_t)/3$$

wherein $S_{baffle}$ is the spacing between the upper edge of the baffle and the bottom of the centrifugal classifier; $D_b$ is the diameter of the baffle, and $D_t$ is the turbine classifier outer diameter.

Further, an optimal elevation of the baffle 100 for a roller mill 40 having a whizzer type classifier 200 is:

$$S_{baffle}=(D_w-D_d)/2$$

wherein $S_{baffle}$ is the spacing between the upper edge of the baffle and the bottom of the whizzer-type classifier; $D_w$ is the outer diameter of the whizzer classifier blades, and $D_d$ is the diameter of the lower deck disc of the whizzer.

Figure 6:
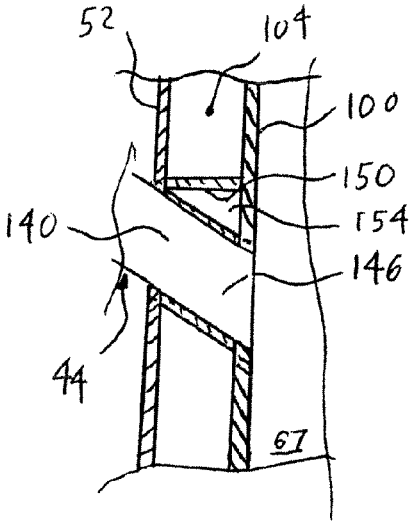
FIG. 6 is a cross-sectional view of a feed duct passing through a mill sidewall and baffle in accordance with the present invention.
Figure 7:
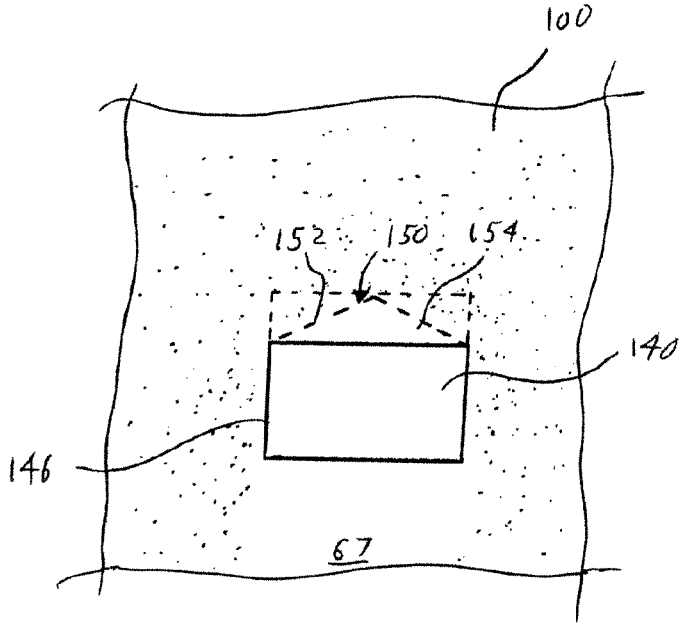
FIG. 7 is a top cross-sectional view of the feed duct of FIG. 6.

Referring to FIG. 2, the mill side wall 52 of the roller miller 40 includes a feed opening 140 for feeding material into the grinding chamber 54. A rotary feeder 42 is attached to the side of the mill side wall 52 for feeding the material through the opening 140 in the mill side wall. The rotary feeder includes a hopper 142 for receiving material to be pulverized in the roller mill and a rotary means 144 for moving the material through the opening 140 to an input chute 146 into the grinding chamber 54. As best shown, in FIGS. 6 and 7, the baffle 100 similarly includes a feed opening 146 to permit the material to also pass through the baffle into the grinding zone 67. The input for chute 146 of the rotary feeder extends through both the mill side wall 52 and the baffle 100. An upper wall 150 of the input chute 146 has a pair of outwardly sloping surfaces 152,154 to prevent the oversized particles flowing downwardly through the return passage 104 from collecting on the top surface of the input feed chute 146 extending therethrough.

In accordance with the mode of operation of the roller mill 40 of FIGS. 2-7 the material, which is to be pulverized, i.e., ground, therewithin, is introduced at a controlled rate by means of the rotary feeder 42, and falls to the mill bottom in the grinding zone at 67. As a result of the coaction between the grinding rolls 64 and the grinding ring 66, the pulverization, i.e., grinding, of the material occurs. A large volume of air enters the roller mill 40 through tangential ports with which the air vents 68 provide for this purpose immediately below the grinding ring 66. This large volume of air 94,96 is operative to sweep the fine and medium fine particles of the now ground material into the separator chamber 80 located directly above the grinding chamber 54. The classifier 44 then classifies the ground material whereby the oversize particles are made to automatically drop back down to the grinding zone 67 within the roller mill 40 whereupon they are subjected to further size reduction, i.e., further grinding. The fine particles of material, on the other hand, that are of the proper size are carried along in the airflow 98 and are subsequently discharged from the roller mill 10 through the duct 69.

Referring to FIGS. 2 and 4, the present invention reduces the recirculation of the rejected oversize particles by creating a separate particle return passage 104, whereby the oversized particles are not subject to the upward airflow 96.

This new mill design involves adding the mill side baffle 100 creating an annular space 104 between the mill side 52 and the baffle 100. This annular space forms a passage for the particles to fall back by gravity to the grinding zone. One small gap is needed at the lower edge 116 of the baffle so that the return particles can flow out to the grinding zone 67. The upper edge 110 of the baffle should extend to a short distance below the classifier 70. This is illustrated in FIG. 1. This new invention with the mill side baffle is suitable for improving the mill efficiency for all size product requirements, as well as, improve the fineness of the ground material.

As discussed hereinbefore, the classifier 44 of FIGS. 2 and 4 may be any centrifugal-type classifier. One such classifier is a two-stage whizzer classifier 200, as depicted in FIG. 8. Components in FIG. 8 similar to those components in FIGS. 2 and 4 have similar function and the same reference number.

Referring to FIG. 8, the rotor 70 of the classifier 200 has an upper set of blades 202 and a lower set of blades 204. The rotor 70 includes a spider 206 attached to the lower end of the vertical classifier shaft 86 whereby the upper and lower set of blades 202, 204 respectively are removably attached thereto using suitable attachment means 208, e.g. screws, nuts and bolts. The respective upper and lower blades are respectively circumferentially spaced around the rotor 70. The number of blades 202, 204 in each set is dependent on a number of factors including desired particle size to pass through the classifier, the dimensions of each blades, and speed of rotation of the rotor. For example, the upper and lower set of blades 202,204 may have 24 number of blades equally spaced around the shaft 86. The blades may be of rectangular shape, as shown in FIG. 8, or may have tapered ends.

The housing 74 of the classifier 200 includes an annular restriction or wall 210 extending inwardly from the classifier wall 76. The annular wall 210 has a flat bottom surface 212 that extends radially inward from the classifier wall and a top chamfered surface 214 that slopes down inwardly. The top surface 214 is sloped to prevent particles from collecting onto the annular wall 210. The bottom surface 212 of the annular wall 210 and the classifier wall 76 define the classifying chamber 80. The annular wall 210 extends sufficiently inward to overlap the ends of the upper blades 202 to prevent particles in the classifying chamber 80 from bypassing the blades 202, 204 of the classifier 200.

The operation of the whizzer classifier 200 is similar to the classifier shown in FIGS. 2 and 4. As the particle-laden airflow passes through the classifying chamber 80 and out the duct 69, the oversized particles impinge on the rotating blades 202, 204 while the finer particles pass therethrough and out the duct. The oversized particles are propelled against the classifier wall 76 and fall through the annular passage 104 defined by the mill side wall 52 and the baffle 104, as described hereinbefore. The two stage whizzer 200 effectively provides two filters for classifying the particles. The lower set of blades 202 provide an initial classification of the particles and the upper set of blades 204 provide a further classification of the particles that pass through or by the lower set of blades. One will appreciate the configuration, dimensions, and shapes of the lower and upper blades 204 may be similar or different. For example, the lower set of blades 202 may have fewer blades than the upper set of blades 204 to provide a gross classification of larger particles, while the upper set provides a finer classification of the rest of the particles passing through.

One will appreciate that present invention is applicable to any type of pendulum type of mills having a vertical grinding ring and grinding rolls, which includes Raymond® Roller Mill and mills from other manufacturers with similar designs.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A roller mill for pulverizing material; said roller mill comprising:

an input chute adapted, to receive said material;

a mill connected to the input chute, adapted to receive said material from the input chute, the mill including a grinding mechanism of at least one grinding roll and grinding ring that coact to pulverize said material prior to other processing of said material within a mill housing that defines a grinding chamber, the pulverized material being released into an air stream to creating particle-laden air;

a classifier adapted to receive the particle-laden air from the mill, the classifier including a rotor having a plurality of blades disposed within a classifier housing defining a classifying chamber, where the rotor rotates to separate fine sized particles from oversized particles, whereby the finer sized particles pass through the blades and exit the classifier and the oversized particles are propelled outward against the classifier housing, the grinding chamber being in fluid communication with the classifying chamber; and a baffle disposed along the inner periphery of the mill housing spaced at least a constant distance from the mill housing as the baffle extends downward to provide an inner passage and an outer annular passage that does not converge as it extends downward, the inner passage being a generally open space for directing the particle-laden air upward through the grinding chamber to the classifier, the outer annular passage receiving and directing the oversized particles downward to the grinding mechanism of the mill such that the baffle minimizes upward forces created by airflow on the oversized particles, the baffle having an opening at the bottom of the outer annular passage for directing the oversized particles to the grinding mechanism.

2. The roller mill of claim 1, wherein the baffle has an upper edge, wherein the upper edge is disposed a distance from the rotor of the classifier whereby the baffle minimally effects the upward airflow to the classifier.

3. The roller mill of claim 1, wherein the baffle has an upper edge, wherein the upper edge is disposed at approximately the height of the mill housing.

4. The roller mill of claim 1, wherein the baffle has an upper edge, wherein the upper edge is disposed above the height of the mill housing.

5. The roller mill of claim 1, wherein the baffle has an upper edge, wherein the upper edge is disposed below the height of the mill housing.

6. The roller mill of claim 1, wherein the baffle has an upper edge, wherein the upper edge is disposed a distance from the classifier in relation to the following:

$$S_{baffle}=(D_b-D_t)/3$$

wherein $S_{battle}$ is the spacing between the upper edge of the baffle and the bottom of the centrifugal classifier; $D_b$ is the diameter of the baffle, and $D_t$ is the turbine classifier outer diameter.

7. The roller mill of claim 1, wherein the baffle has an upper edge, wherein the upper edge is disposed a distance from the classifier in relation to the following:

$$S_{baffle}=(D_w-D_d)/2$$

wherein $S_{battle}$ is the spacing between the upper edge of the baffle and the bottom of the turbine classifier; $D_w$ is the outer diameter of the whizzer classifier blades, and $D_d$ is the diameter of the lower deck disc of the whizzer.

8. The roller mill of claim 1, wherein the baffle has a lower edge, wherein the lower edge is disposed a distance from the grinding mechanism in relation to the following:

$$S_{baffle}=0.5(D_b-D_r)\tan(\theta)+1 \text{ inch}$$

wherein $S_{baffle}$ is the spacing between the lower edge of the baffle and the grinding ring; $D_b$ is the diameter of the baffle; $D_r$ is the inner diameter of the grinding ring; and $\theta$ is the material angle of repose.

9. The roller mill of claim 1, wherein the spacing of the baffle and mill side wall is:

$$D_{baffle}=0.5(D_h+D_r)$$

wherein $D_{baffle}$ is the diameter of the baffle; $D_h$ is the inner diameter of the mill housing; and $D_r$ is the inner diameter of the grinding ring.

10. The roller mill of claim 1, wherein the spacing between the baffle and the mill housing is sufficiently wide to receive a substantial portion of the oversized particles.

11. The roller mill of claim 1, wherein the baffle has a lower edge, wherein the lower edge is disposed a sufficient distance from the grinding mechanism to permit the oversize particles to exit the annular passage but sufficiently narrow to minimize upward air flow to pass into the annular passage.

12. The roller mill of claim 1, wherein the classifier is a centrifugal type classifier.

13. The roller mill of claim 1, wherein the classifier is a turbine classifier.

14. The roller mill of claim 1, wherein the classifier is a whizzer classifier.

15. The roller mill of claim 14, wherein the classifier is a single stage or double stage whizzer classifier.

16. The roller mill of claim 1, wherein the baffle includes a feeder opening to permit material for pulverizing to pass through the baffle from a feeder.

17. The roller mill of claim 1, wherein the baffle is disposed in fixed position with the mill housing a plurality of standoffs.

18. The roller mill of claim 1, further including a sloped annular ramp disposed circumferentially around a lower portion of the mill housing approximate the lower opening of the annular passage for directing the oversized particles to the grinding mechanism.

19. The roller mill of claim 18, wherein the sloped annular ramp includes a slope of approximately 30-60 degrees.

20. A mill for pulverizing material; said mill comprising:

an input chute adapted to receive said material;

a grinding means connected to the input chute, for first receiving and pulverizing said material within a mill housing that defines a grinding chamber prior to any other processing of said material;

a classifying means for receiving the pulverized material from the grinding means and for centrifugally separating oversized particles from finer particles, wherein the finer sized particles pass through the classifying means and the oversized particles are propelled outward and downward to the grinding means; and a baffle disposed along the inner periphery of the mill housing spaced at least at a constant distance from the mill housing as the baffle extends downward to provide an inner passage and an outer annular passage that does not converge as it extends downward, the inner passage being a generally open space for directing the particle-laden air upward through the grinding chamber to the classifier, the outer annular passage receiving and directing the oversized particles downward to the grinding means of the mill, the baffle functioning to minimize upward forces from airflow on the oversized particles passing downward through the outer annular passage, the baffle having an opening at the bottom of the outer annular passage for directing the oversized particles to the grinding means.

* * * * *